United States Patent [19]

Koyama et al.

[11] Patent Number: 4,548,394

[45] Date of Patent: Oct. 22, 1985

[54] COPYING PAPER CONVEYING DEVICE IN ELECTROSTATIC COPYING APPARATUS

[75] Inventors: Shigeo Koyama, Higashi Osaka; Hiromi Sakata, Neyagawa, both of Japan

[73] Assignee: Mita Industrial Co., Ltd., Osaka, Japan

[21] Appl. No.: 530,846

[22] Filed: Sep. 9, 1983

[30] Foreign Application Priority Data

Sep. 14, 1982 [JP] Japan ..... 57-160658

[51] Int. Cl.[4] ..... B65H 5/06; B65H 29/20; B65H 3/44

[52] U.S. Cl. ..... 271/9; 271/266; 271/265; 271/10; 271/272; 271/242; 271/235

[58] Field of Search ..... 271/9, 10, 21, 226, 271/227, 228, 234, 235, 242, 245, 246, 266, 270, 272, 273, 274; 355/3 SH, 14 SH

[56] References Cited

U.S. PATENT DOCUMENTS

| | | | |
|---|---|---|---|
| 3,863,913 | 2/1975 | Hirafuji | 271/270 |
| 3,963,339 | 6/1976 | Taylor et al. | 271/9 |
| 3,966,198 | 6/1976 | Komada et al. | 271/270 |
| 4,009,957 | 3/1977 | Suzuki et al. | 271/9 |
| 4,221,375 | 9/1980 | Morrison et al. | 271/9 |
| 4,337,435 | 7/1982 | Sawada et al. | 271/242 |
| 4,451,030 | 5/1984 | Teetes et al. | 271/265 |

FOREIGN PATENT DOCUMENTS

| | | | |
|---|---|---|---|
| 0095047 | 6/1983 | Japan | 271/9 |
| 0100039 | 6/1983 | Japan | 271/9 |

*Primary Examiner*—Duane A. Reger
*Assistant Examiner*—James E. Barlow
*Attorney, Agent, or Firm*—Beveridge, DeGrandi & Weilacher

[57] ABSTRACT

A copying paper conveying device for conveying a sheet of copying paper having an upper and a lower introducing passage and a main conveying passage extending from a point of meeting of the upper and lower introducing passages. A pair of conveyor rollers are disposed in the upper introducing passage, and a pair of timing rollers are diposed in the main conveying passage. At least the downstream sections of the upper and lower introducing passages are partitioned by a common guide plate, and at least the downstream section of the common guide plate is formed of a flexible material. When a copying paper is conveyed through the upper introducing passage and the main conveying passage, the pair of conveying rollers are actuated in relation to the operation of the pair of timing rollers, and the copying paper is maintained bent between the pair of conveying rollers and the pair of timing rollers at least until the trailing edge of the copying paper leaves the pair of conveying rollers.

6 Claims, 6 Drawing Figures

2
4
6
8
10
12
14
16
18
20
22
24
26
28
30
32a
32b
34a
34b
36a
36b
38a
38b
40a
40b
42a
42b
44a
44b
46a
46b
46
48
50
52
54
56
58
60
62
64
66
68
70
72
74
76
78
80
82
84
86
88
90
92
94
96
98
100
102
104
148
L1
L2
ℓ1
ℓ2

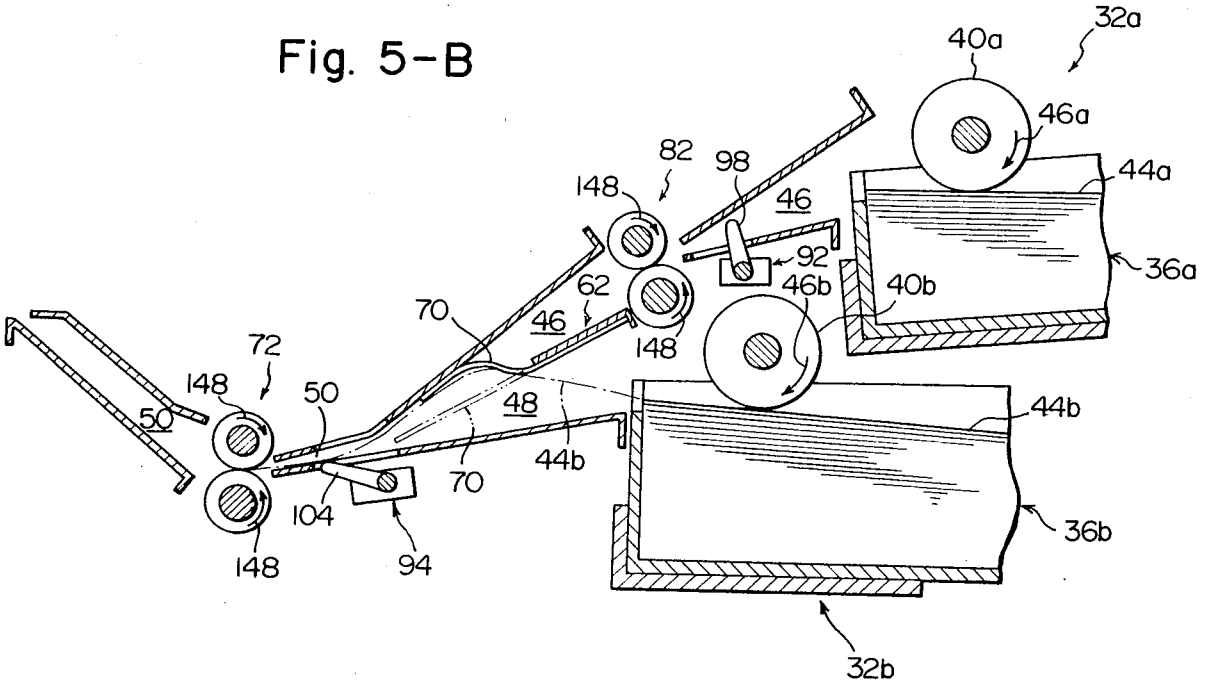
Fig. 5-B

COPYING PAPER CONVEYING DEVICE IN ELECTROSTATIC COPYING APPARATUS

FIELD OF THE INVENTION

This invention relates to a copying paper conveying device in an electrostatic copying apparatus, and more specifically to a copying paper conveying device for conveying a sheet of copying paper in the desired manner in an electrostatic copying apparatus.

DESCRIPTION OF THE PRIOR ART

As is well known, electrostatic copying apparatuses are provided with a paper conveying device for conveying a sheet of copying paper in the desired manner every time the copying cycle is performed. The paper conveying device generally includes a paper feed means for feeding a sheet of copying paper every time the copying cycle is performed, a guide means defining a conveying passage for the copying paper fed from the paper feed means and a pair of timing rollers disposed in the conveying passage. Frequently, two or more paper feeding means are arranged vertically in spaced-apart relationship so as to feed a copying paper sheet properly selected from at least two kinds of copying paper sheets different from each other in size, color, material, etc. In this embodiment, the conveying passage has a plurality of introducing passages extending respectively from the two or more paper feed means and meeting at a point and a common main conveying passage extending from this point of meeting, and the pair of timing rollers are disposed in the upstream section of the main conveying passage.

In the aforesaid paper conveying device, a sheet of copying paper advancing through the conveying passage is bent upstream of the pair of timing rollers when its leading edge has abutted against the pair of timing rollers held in an inoperative condition. As is known to those skilled in the art, the leading edge of the copying paper fed from the paper feeding means is not substantially at right angles to the conveying direction but is slightly inclined to it, and therefore, the copying paper is frequently conveyed in the slightly inclined state through the conveying passage. But when the leading edge of the copying paper abuts against the pair of timing rollers in an inoperative condition, the direction of the copying paper is corrected so that its leading edge is substantially at right angles to the conveying direction. Then, the pair of timing rollers is set in operation at a predetermined time, and advancing of the copying paper by the pair of timing rollers is started. For example, in the case of a toner image transfer-type electrostatic copying apparatus in which a toner image is formed on an electrophotographic material disposed on a rotating drum and then transferred to a copying paper, the aforesaid predetermined time at which the timing rollers are rendered operative is set in a predetermined relation to the rotation of the rotating drum, and as a result, the movement of the toner image formed on the electrophotographic material is synchronized in the desired manner with that of the copying paper.

The known copying paper conveying device of the above structure has the following problems or defects to be solved or removed.

Firstly, a problem arises particularly when two or more copying paper feed means are disposed vertically in spaced-apart relationship and therefore the conveying passage has a plurality of introducing passages.

Because of the arrangement of the paper feed means and the introducing passages, it is frequently necessary in this case that the length of the conveying path of a copying paper from at least one specific paper feed means to the pair of timing rollers to which it is conveyed through at least one specific introducing passage should be made larger than the length of the copying paper in the conveying direction. In order to convey the copying paper accurately through the introducing passage in this case, it is necessary to provide a pair of conveying rollers in the introducing passage and to make both the length of the conveying path of the copying paper from the paper feed means to the pair of conveying rollers and the length of the conveying path of the copying paper from the pair of conveying rollers to the pair of timing rollers shorter than the length of the copying paper in its conveying direction. When the leading edge of the copying paper advancing under the action of the pair of conveying rollers in the operative state abuts against the pair of timing rollers in the inoperative state, the copying paper is bent between the pair of conveying rollers and the pair of timing rollers, and thereafter the pair of conveying rollers are held in an inoperative condition. Then, at the aforesaid predetermined time, the pair of timing rollers are set in operation, and advancing of the copying paper by the timing rollers is started. When the pair of timing rollers are set in operation and advancing of the copying paper by the pair of timing rollers is started, the trailing edge portion of the copying paper is still nipped by the pair of conveying rollers. The pair of conveying rollers are held in the inoperative state when advancing of the copying paper by the pair of timing rollers is started. Accordingly, with the advancing of the copying paper by the pair of timing rollers, the bending of the copying paper between the pair of conveying rollers and the pair of timing rollers is gradually removed, and after the bending of the copying paper is completely removed, the trailing edge portion of the copying paper is pulled out of the pair of conveying rollers by the advancing of the copying paper caused by the pair of timing rollers. The pair of conveying rollers in the inoperative state are maintained in a freely rotatable condition so as not to hamper the withdrawing of the trailing edge portion of the copying paper therefrom. However, since for one thing the nipping pressure of the pair of conveying rollers is set at a considerably high value in order for the pair of conveying rollers in the operative state to surely advance the copying paper fed from the paper feed means, the pair of conveying rollers in the inoperative state exert some degree of resistance on the withdrawal of the trailing edge portion of the copying paper therefrom. This leads to a tendency toward the generation of some slippage between the pair of timing rollers in the operative state and the copying paper advanced thereby. It will be easily understood that when such slippage is generated, an error corresponding to the slippage occurs in the advancing of the copying paper, and therefore in the case of the aforesaid toner image transfer-type electrostatic copying apparatus for example, an error occurs in the synchronized movement of the copying paper and the toner image formed on the electrophotographic material, and consequently, the toner image transferred to the copying paper will deviate from the desired position to an extent corresponding to the aforesaid error.

Secondly, sufficient bending of the copying paper upstream of the pair of timing rollers is of importance in order to correct surely the inclination of the copying paper by causing the leading edge of the advancing copying paper to abut against the pair of timing rollers in the inoperative state. Generally, the paper conveying passage is defined by a pair of guide plates disposed vertically in spaced-apart relationship. In order to permit the copying paper to be bent sufficiently at a site upstream of the pair of timing rollers, the vertical distance between the guide plates should be made sufficiently large at a site upstream of the pair of timing rollers. However, when two or more paper feed means are arranged vertically in spaced-apart relationship and therefore two or more introducing passages meeting at a point upstream of the pair of timing rollers are provided, to allow a sufficient vertical distance between the guide plates defining each introducing passage results in a considerable increase in the vertical size of the conveying passage as a whole, and this makes it impossible to build the copying apparatus in a compact size. Usually, the copying paper advancing through ech of the introducing passages is moved along the surfce of a lower guide plate difining the lower surface of each of the introducing passages. If the vertical distance between the pair of guide plates defining each introducing passage is made sufficiently large, the vertical positions of the guide plates defining the lower surfaces of the respective introducing passages naturally differ considerably at the point of meeting of the introducing passages, and a considerably large difference in level exists in the lower surface of the conveying passage at the point of meeting. This is likely to hamper smooth advancing of the copying paper and lead to paper jamming and other troubles.

SUMMARY OF THE INVENTION

A primary object of this invention is to provide copying paper conveying device in an electrostatic copying apparatus in which a pair of conveying rollers are disposed upstream of a pair of timing rollers and at the start of advancing of a copying paper by the pair of timing rollers held in the operative state, the copying paper is bent between the pair of conveying rollers and the pair of timing rollers and the trailing edge portion of the copying paper is nipped by the pair of conveying rollers, said device being improved in that at least before the trailing edge of the copying paper leaves the pair of conveying rollers after the start of advancing of the copying paper by the pair of timing rollers held in the operative state, the copying paper is maintained bent between the pair of conveying rollers and the pair of timing rollers, whereby the pair of conveying rollers are surely prevented from resisting advancing of the copying paper and therefore, an error in the advancing of the copying paper owing to slippage between the pair of timing rollers and the copying paper is surely avoided.

A secondary object of this invention is to provide a copying paper conveying device in an electrostatic copying apparatus in which two or more copying paper feed means are provided vertically in spaced-apart relationship and two or more introducing passages meeting at a point upstream of a pair of timing rollers are provided, said device being improved in that the vertical size of a connveying passage as a whole can be made sufficiently small and smooth advancing of a copying paper can be secured in spite of the fact that the copying paper is permitted to be bent sufficiently upstream of the pair of timing rollers.

The primary object, according to one aspect of this invention, is achieved by a copying paper conveying device in an electrostatic copying apparatus, comprising a paper feed means for feeding a sheet of copying paper, a guide means defining a conveying passage for copying paper fed from said paper feed means, a pair of conveying rollers disposed in said conveying passage for advancing the copying paper from the paper feed means through said conveying passage, a pair of timing rollers disposed in said conveying passage downstream of the pair of conveying rollers and a control means for controlling said paper feed means, said pair of conveying rollers and said pair of timing rollers, the length of the conveying passage between the pair of conveying rollers and the pair of timing rollers being shorter than the length of the copying paper in the conveying direction, and said control means being adapted to make the pair of conveying rollers inoperative after the copying paper advancing under the action of the pair of conveying rollers in the operative state is bent between the pair of conveying rollers and the pair of timing rollers by the abutting of its leading edge against the pair of timing rollers in the inoperative state, and thereafter to make the pair of timing rollers operative at a predetermined time thereby starting the advancing of the copying paper by the pair of timing rollers; characterized in that said control means also makes the pair of conveying rollers operative in required relation to said predetermined time of making the pair of timing rollers operative, so that the copying paper is maintained bent between the pair of conveying rollers and the pair of timing rollers after advancing of the copying paper is started by setting the pair of timing rollers in operation and at least before the trailing edge of the copying paper leaves the pair of conveying rollers.

The secondary object, according to another aspect of this invention, is achieved by a copying paper conveying device in an electrostatic copying apparatus, comprising an upper and a lower paper feed means arranged vertically in spaced-apart relationship for feeding a sheet of copying paper, a guide means defining a paper conveying passage having an upper and a lower introducing passage extending respectively from said upper and lower paper feed means and meeting at a point and a main conveying passage extending from said point of meeting of the upper and lower introducing passages, a pair of timing rollers disposed in the upstream section of the main conveying passage, and a control means for controlling the upper and lower paper feed means and the pair of timing rollers, said control means being adapted to make the pair of timing rollers operative, and thus start advancing of the copying paper, at a predetermined time after the copying paper fed from the upper or lower paper feed means and advancing through the upper or lower introducing passage is bent upstream of the pair of timing rollers by the abutting of its leading edge against the pair of timing rollers in the inoperative state; characterized in that said guide means includes a common guide plate defining at least the downstream section of the upper introducing passage and at least the downstream section of the lowering introducing passage, and at least the downstream section of the common guide plate is formed of a flexible material capable of bending according to the bending of the copying paper which takes place upstream of the pair of timing rollers.

Other objects of this invention along with various advantages obtained by the invention will become apparent from the following description.

BRIEF DESCRIPTION OF THE ACCOMPANYING DRAWINGS

FIGS. 5-A and 5-B are simplified sectional views for illustrating the operation of the copying paper conveying device illustrated in FIG. 1.

DETAILED DESCRIPTION OF PREFERRED EMBODIMENTS

The invention is described below in detail with reference to the accompanying drawings.

Figure 1:
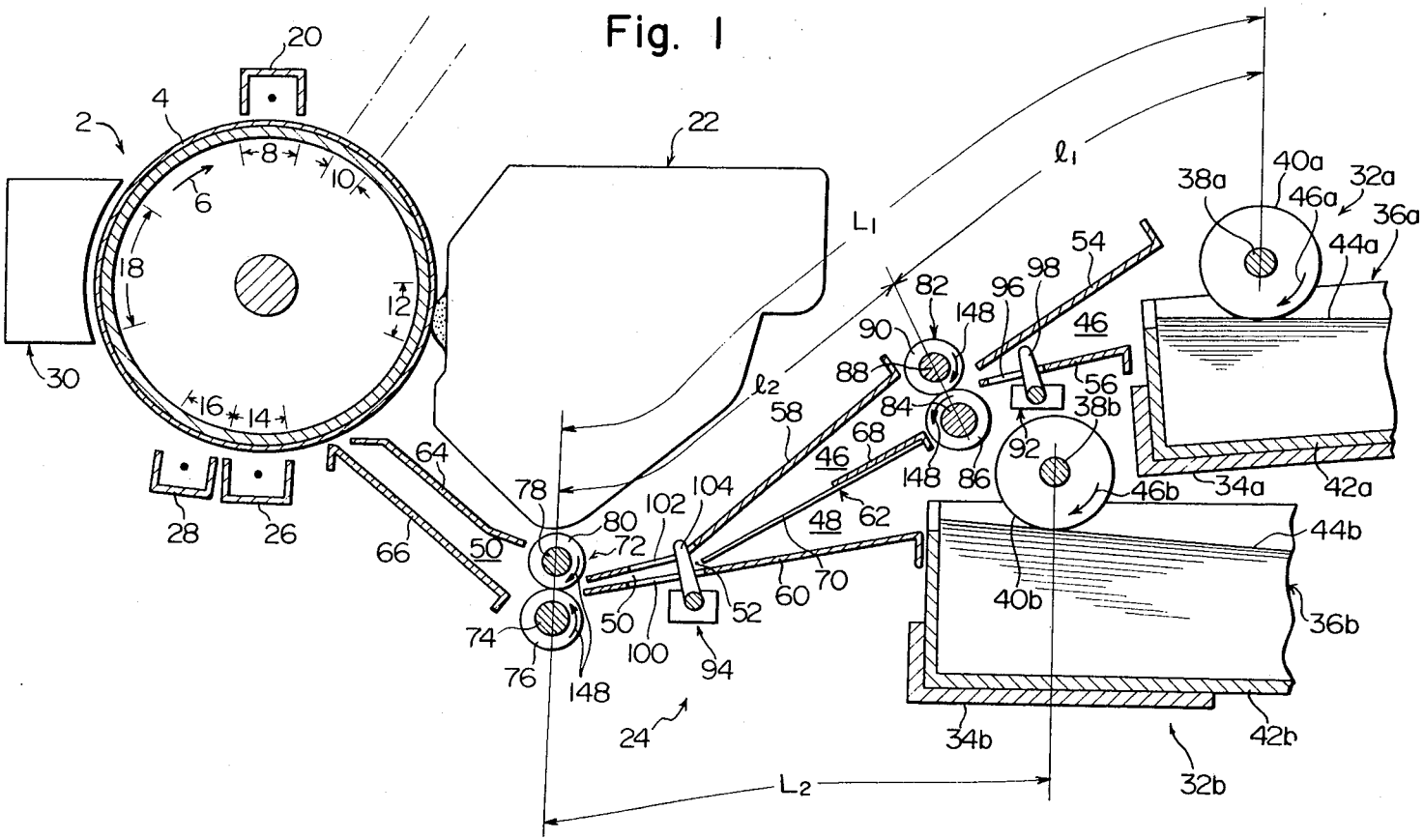
FIG. 1 is a simplified sectional view showing a part of a toner image transfer-type electrostatic copying apparatus provided with one embodiment of a copying paper conveying device improved in accordance with this invention.

FIG. 1 shows in a simplified form a part of a toner image transfer-type electrostatic copying apparatus provided with one embodiment of a copying paper conveying device improved in accordance with this invention. The illustrated electrostatic copying apparatus includes a rotating drum 2 having an electrophotographic material 4 on its peripheral surface. Around the rotating drum 2 are arranged a charging zone 8, an exposing zone 10, a developing zone 12, a transfer zone 14, a peeling zone 16 and a cleaning zone 18 in this order in the rotating direction of the rotating drum shown by an arrow 6. In the charging zone 8, the electrophotographic material 4 is charged to a specified polarity by a charging corona discharge device 20. In the exposing zone 10, an image of a document (not shown) to be copied is projected onto the electrophotographic material 4 through an optical unit (not shown), and a latent electrostatic image corresponding to the image of the document is formed on the electrophotographic material 4. Then, toner is applied to the electrophotographic material 4 in the developing zone 12 by a developing device of a suitable type shown generally at 22, thereby developing the latent electrostatic image on the electrophotographic material 4 to a toner image. In the transfer zone 14, a sheet of copying paper conveyed by the copying paper conveying device generally shown at 24 which is improved in accordance with this invention (the paper conveying device 24 will be described in detail hereinafter) is brought into contact with the surface of the electrophotographic material 4, and by the action of a transfer corona discharge device 26, the toner image on the electrophotographic material 4 is transferred to the copying paper. The copying paper is peeled from the surface of the electrophotographic material 4 in the peeling zone 16 by the action of a peeling corona discharge device 28. The peeled copying paper is conveyed further to a suitable fixing device (not shown) where the toner image transferred to the copying paper is fixed. In the cleaning zone 18, residual toner (and a residual charge) remaining on the electrophotographic material 4 after the transfer are removed by a cleaning device shown generally at 30. The above structure in the illustrated electrostatic copying apparatus is only one example of electrostatic copying apparatus to which the copying paper conveying device improved in accordance with this invention can be applied, and is well known to those skilled in the art. Hence, a detailed description of it would be unnecessary.

With reference to FIG. 1, the illustrated copying paper conveying device 24 includes two copying paper feed means vertically spaced from each other, namely an upper copying paper feed means **32*a* and a lower copying paper feed means 32*b*. The upper and lower copying paper feed means 32*a* and 32*b*, which may be of any known type, respectively comprise cassette-receiving stands 34*a* and 34*b*, copying paper cassettes 36*a* and 36*b* to be detachably mounted on the cassette-receiving stands 34*a* and 34*b*, and feed rollers 40*a* and 40*b* fixed to rotatably mounted shafts 38*a* and 38*b*. The paper cassettes 36*a* and 36*b* are composed respectively of cassette cases 42*a* and 42*b* and stacks of copying paper sheets 44*a* and 44*b* accomodated in the cassette cases 42*a* and 42*b*. The copying paper sheets 44*a* may differ from the copying paper sheets 44*b* in size (or color, material, etc.). With such upper and lower paper feed means 32*a* and 32*b*, the feed rollers 40*a* and 40*b* are selectively rotated in the directions shown by arrows 46*a* and 46*b* to feed the uppermost copying paper in the stacks of copying paper sheets 44*a* and 44*b* in the paper cassettes 36*a* and 36*b* to the left in FIG. 1**.

If desired, instead of the aforesaid so-called "cassette-type" copying paper feed means **32*a* and 32*b*, another suitable type of copying paper feed means, such as a type adapted to feed a copying paper sheet cut off to the required length from a roll of copying paper, may be used. Furthermore, the copying paper fed from the paper feed means 32*a* and 32*b*** is not limited to a sheet of paper itself but may be a plastic film for use in overhead projectors. Accordingly, it should be understood that the term "copying paper", as used in the present application, denotes not only paper itself but also a plastic film and the like.

Figures 2, 3:
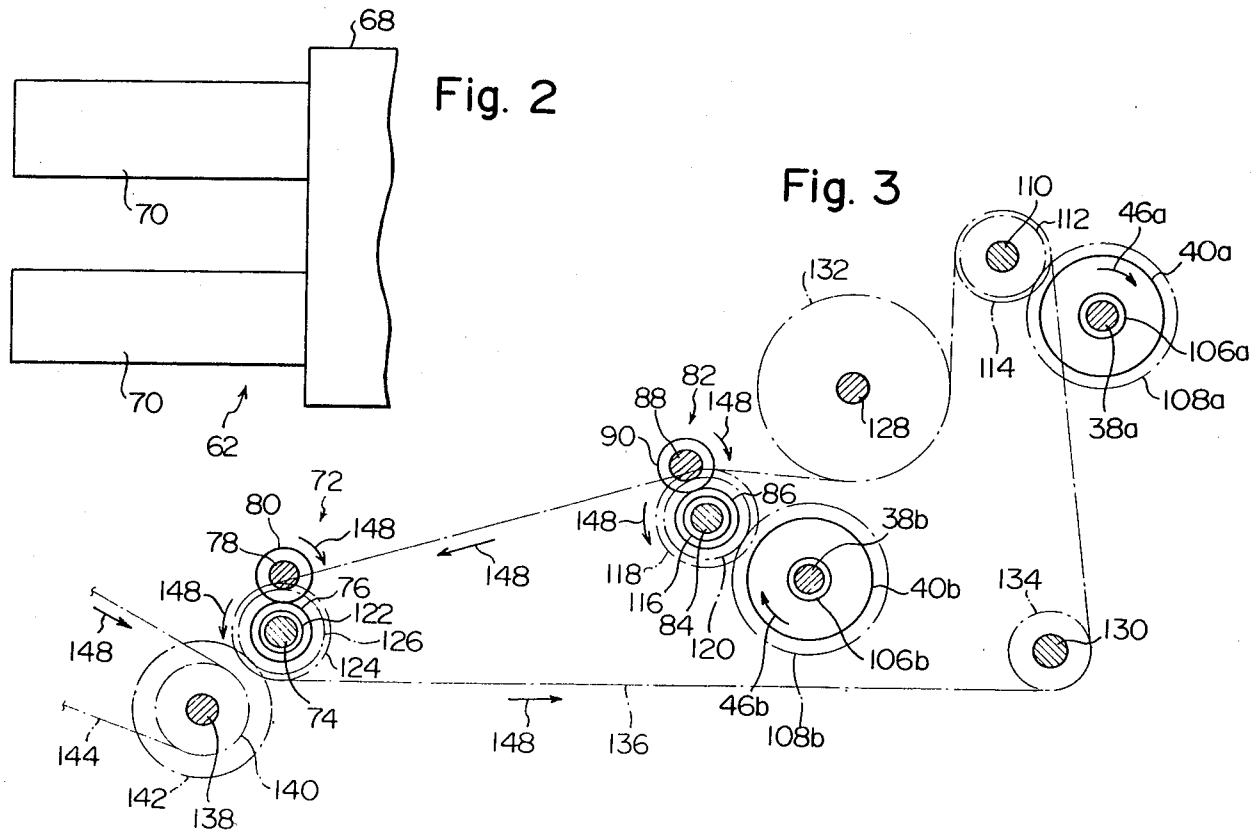
FIG. 2 is a partial plan view showing a common guide plate in the copying paper conveying device illustrated in FIG. 1.
FIG. 3 is a simplified sectional view showing a transmission system in the copying paper conveying device illustrated in FIG. 1.

The copying paper conveying device 24 is equipped with a paper conveying passage consisting of an upper and a lower introducing passages 46 and 48 and a main conveying passage 50. The upper introducing passage 46 extends from the upper paper feed means **32*a*, and the lower introducing passage 48 extends from the lower paper feed means 32*b*. The upper introducing passage 46 and the lower introducing passage 48 meet at a point at their downstream ends. The main conveying passage 50 extends from a point 52 of meeting of these introducing passages 46 and 48. The upstream section of the upper introducing passage 46 is defined by a pair of guide plates 54 and 56 disposed vertically in spaced-apart relationship. The downstream section of the upper introducing passage 46 and the whole of the lower introducing passage 48 are defined by partitioning the upstream section of the space between a pair of guide plates 58 and 60 spaced from each other vertically, by a common guide plate 62. In other words, the downstream section of the upper introducing passage 46 is defined by the upstream section of the guide plate 58 and the common guide plate 62, and the whole of the lower introducing passage 48 is defined by the common guide plate 62 and the upstream section of the guide plate 60. The main conveying passage 50 is defined by the pair of guide plates 58 and 60 and a pair of guide plates 64 and 66 spaced from each other vertically. The guide plates 54, 56, 58, 60, 64 and 66 fixed in place may be made of metallic plates, plastic plates, etc. and may be relatively rigid. It is important however that at least the downstream section of the common guide plate 62 should be formed of a flexible material so as to be able to bend according to the bending of the copying paper as stated hereinafter. In the illustrated common guide plate 62, its upstream section is formed of a relatively rigid metallic or plastic plate 68 fixed in place, and its downstream section is formed of a tape-like piece 70 of flexible material with the upper surface of its upstream end portion being bonded to the under surface of the metallic or plastic plate 68. Although a single tape-like piece having a relatively large width may be used, it is preferred to arrange a plurality of (two in the illustrated embodiment) tape-like pieces 70 of a relatively narrow width at intervals in the widthwise direction as shown in FIG. 2. Conveniently, the tape-like pieces 70** are plastic films, for example polyester films having a thickness of about 0.1 mm.

With reference to FIG. 1, a pair of timing rollers shown generally at 72 are disposed the upstream section of the main conveying passage 50, more particularly, between the downstream ends of the guide plates 58 and 60 and the upstream ends of the guide plates 64 and 66. The illustrated pair of timing rollers 72 are comprised of a metallic driven roller 76 fixed to a rotatably mounted shaft 74 and a follower roller 80 of synthetic rubber fixed to a rotatably mounted shaft 78. The shaft 78 is elastically urged toward the shaft 74 by a spring means (not shown), and thereby the follower roller 80 is elastically pressed against the driven roller 76.

In the illustrated embodiment, the length $L_2$ of the conveying passage from the lower paper feed means **32*b* to the pair of timing rollers 72 for the copying paper 44*b* fed from the lower paper feed means 32*b* and conveyed through the lower introducing passage 48 is sufficiently shorter than the length of the copying paper 44*b* in its conveying direction, but the length $L_1$ of the conveying passage from the upper paper feed means 32*a* to the pair of timing rollers 72 for the copying paper 44*a* fed from the upper paper feed means 32*a* and conveyed through the upper introducing passage 46 is larger than the length of the copying paper 44*a* in its conveying direction. Accordingly, in order to advance the copying paper 44*a* surely through the upper introducing passage 46, a pair of conveying rollers shown generally at 82 are disposed in the upper introducing passage 46, more specifically between the downstream ends of the guide plates 54 and 56 and the upstream ends of the guide plate 58 and the common guide plate 62. The length $l_1$ from the upper copying paper feed means 32*a* to the pair of conveying rollers 82 and the length $l_2$ from the pair of conveying rollers 82 to the pair of timing rollers 72 are both sufficiently shorter than the length of the copying paper 44*a* in its conveying direction. The illustrated pair of conveying rollers 82 consist of a metallic driven roller 86 fixed to a rotatably mounted shaft 84 and a follower roller 90 of synthetic rubber fixed to a rotatably mounted shaft 88. The shaft 88 is urged elastically toward the shaft 84 by a spring means (not shown), and thereby the follower roller 90 is elastically pressed against the driven roller 86. In the illustrated conveying device 24, a first detector 92 and a second detector 94 are provided. The first detector 92 has a detecting arm 98 projecting into the upper introducing passage 46 upstream of the pair of conveying rollers 82 through an opening 96 formed in the guide plate 56. The second detector 94 has a detecting arm 104 which extends through an opening 100 formed in the guide plate 60, crosses that part of the main conveying passage 50 which is upstream of the pair of timing rollers 72, and projects upwardly through an opening 102 formed in the guide plate 58**.

Now, with reference to FIG. 3 taken in conjunction with FIG. 1, there will be described a transmission system provided in relation to the feed rollers **40*a* and 40*b*, the pair of timing rollers 72 and the pair of conveying rollers 82 in the copying paper conveying device 24**.

A suitable clutch means **106*a* such as a one-way spring clutch is mounted on one end portion of the shaft 38*a* to which the feed roller 40*a* is fixed in the upper paper feed means 32*a*, and a gear 108*a* is also rotatably mounted on the aforesaid end portion of the shaft 38*a*. When the clutch means 106*a* is set in operation, the gear 108*a* is drivingly connected to the shaft 38*a*. On the other hand, when the clutch means 106*a* is set out of operation, the gear 108*a* is separated from the shaft 38*a* to allow the shaft 38*a* to rotate freely in the direction of an arrow 46*a*. A shaft 110 is provided adjacent to the shaft 38*a*. A gear 112 and a sprocket wheel 114 capable of rotating with the gear 112 as a unit are rotatably mounted on the shaft 110, and the gear 112 kept in mesh with the gear 108*a*. Furthermore, a suitable clutch means 106*b* such as a one-way spring clutch is mounted on one end portion of the shaft 38*b* to which the feed roller 40*b* is fixed in the lower copying paper feed means 32*b*, and a gear 108*b* is also rotatably mounted on the aforesaid one end portion of the shaft 38*b*. When the clutch means 106*b* is set in operation, the gear 108*b* is drivingly connected to the shaft 38*b*. On the other hand, when the clutch means 106*b* is set out of operation, the gear 108 is separated from the shaft 38*b* to allow the shaft 38*b* to rotate freely in the direction of an arrow 46*b***.

A suitable clutch means 116 is mounted on one end portion of the shaft 84 in the pair of conveying rollers 82. A spricket wheel 118 and a gear 120 capable of rotating with the sprocket wheel 118 as a unit are rotatably mounted on the aforesaid one end of the shaft 84. When the clutch means 116 is set in operation, the sprocket wheel 118 is drivingly connected to the shaft 84. On the other hand, when the clutch means 116 is set out of operation, the sprocket wheel 118 is separated from the shaft 84. The gear 120 is kept in mesh with the gear **108*b***.

A suitable clutch means 122 is mounted on one end portion of the shaft 74 in the pair of timing rollers 72, and a sprocket wheel 124 and a gear 126 capable of rotating with the sprocket wheel 124 as a unit are rotatably mounted on the aforesaid one end portion of the shaft 74. When the clutch means 122 is set in operation, the sprocket wheel 124 is drivingly connected to the shaft 74. On the other hand, when the clutch means 122 is set out of operation, the sprocket wheel 124 is separated from the shaft 74.

In the illustrated embodiment, shafts 128 and 130 are further provided. Tension sprocket wheels 132 and 134 are rotatably mounted on the shafts 128 and 130, respectively. An endless chain 136 is wrapped about the sprocket wheels 124. 134, 114, 132 and 118. A shaft 138 is also provided adjacent to the shaft 74, and a sprocket wheel 140 and a gear 142 capable of rotating with the sprocket wheel 140 as a unit are rotatably mounted on the shaft 138. The gear 142 is kept in mesh with the gear 126. An endless chain 144 (a part of which is shown in the drawing) is wrapped about the sprocket wheel 140, and drivingly connected to a drive source 146 (FIG. 4) which may be an electric motor through a suitable transmission system (not shown). The drive source 146 is drivingly connected also to the rotating drum 2 through a suitable transmission system (not shown).

When the drive source 46 (FIG. 4) is energized, the endless chain 144 is moved in the direction shown by an arrow 148, and therefore, the endless chain 136 is moved in the direction shown by an arrow 148. When the clutch means 106*a* is set in operation, the feed roller 40*a* is rotated in the direction of arrow 46*a*. When the clutch means 106*b* is set in operation, the feed roller 40*b* is rotated in the direction of arrow 46*b*. When the clutch means 116 is set in operation, the pair of conveying rollers 82 are rotated in the direction of arrow 148. The pair of timing rollers 72 are rotated in the direction of arrow 148 when the clutch means 122 is set in operation.

Figure 4:
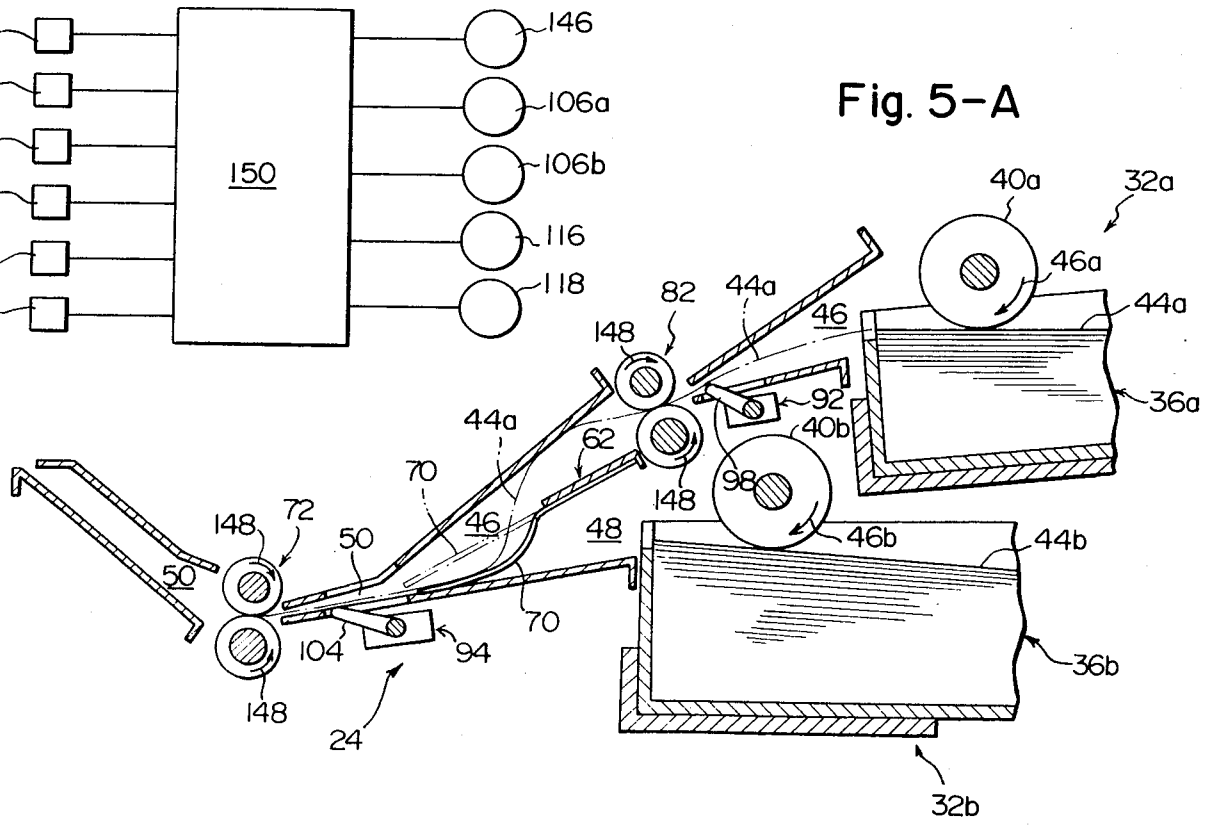
FIG. 4 is a block diagram showing a control system for the electrostatic copying apparatus illustrated in FIG. 1.

With reference to FIG. 4, the aforesaid drive source 146 and clutch means 106*a*, 106*b*, 116 and 122 are controlled by a control means 150 comprised of microprocessors. The first and second detectors 92 and 94 are connected to the control means 150. Furthermore, a manually operable main switch 152, a copy start switch 154, a copying paper selection switch 156, and a detector 158 for setting the clutch means 122 in operation in required relation to the rotation of the rotating drum 2 are connected to the control means 150. The detector 158 may be one which can detect the rotation of the rotating drum 2, or the movement of a suitable member (not shown) to be driven in relation to the rotation of the rotating drum 2.

When the main switch 152 is closed, the drive source 146 is energized, and the rotating drum 2 is rotated in the direction of arrow 6. Furthermore, the endless chains 144 and 136 are moved in the direction of arrow 148. Upon subsequent closing of the copy start switch 154, either one of the clutch means 106*a* and 106*b* is set in operation, and the feed roller 40*a* or 40*b* is rotated in the direction of arrow 46*a* or 46*b*. As a result, feeding of the copying paper 44*a* or 44*b* from the copying paper feed means 32*a* or 32*b* is started. By operating the paper selection switch 156, one can select either one of the cluth means 106*a* and 106*b* to by set in operation, thus either of the copying paper 44*a* or 44*b* to be fed from the paper feed means 32*a* or 32*b*. Simultaneously with, or subsequently to, the starting of feeding of the copying paper 44*a* or 44*b*, the various means in the electrostatic copying apparatus are operated in a proper sequence, and the copying cycle is performed.

The operation of the copying paper conveying device 24 improved in accordance with this invention will be described in detail.

First, with reference mainly to FIG. 5-A, the operation will be described about the case of feeding the copying paper 44*a* from the paper feed means 32*a*. When the clutch means 106*a* is set in operation as stated above and the feed roller 40*a* is rotated in the direction of arrow 46, the uppermost copying paper 44*a* in the stack of copying paper sheets 44*a* is fed into the upper introducing passage 46. The leading edge of the copying paper 44*a* being fed acts on the detecting arm 98 of the first detector 92 to close the first detector 92. As a result, the clutch means 116 is set in operation, and the pair of conveying rollers 82 begin to be rotated in the direction of arrow 148. Accordingly, after the leading edge of the copying paper 44*a* being fed has reached the nipping position of the pair of conveying rollers 82, the pair of conveying rollers 82 advance the copying paper 44*a* through the upper introducing passage 46. After a predetermined period of time has elapsed from the closing of the first detector 92, the clutch means 106*b* is rendered inoperative. However, since at this time the trailing edge portion of the copying paper 44*a* advancing under the action of the pair of conveying rollers 82 is in contact with the feed roller 40*a*, the feed roller 40*a* continues to be rotated in the direction of arrow 46 according to the advancing of the copying paper 44*a*. The feed roller 40*a* stops rotating when the trailing edge of the copying paper 44*a* being advanced by the pair of conveying rollers 82 leaves the feed roller 40*a*.

When the copying paper 44*a* is delivered into the main conveying passage 50 from the upper introducing passage 46 by the action of the conveying rollers 82 and continues to advance, the leading edge of the copying paper 44*a* acts on the detecting arm 104 of the second detector 94, and consequently, the second detector 94 is closed. When the copying paper 44*a* further continues to advance under the action of the pair of conveying rollers 82, the leading edge of the copying paper 44*a* abuts against the nipping portion of the pair of timing rollers 72 in the inoperative state. Thus, when the leading edge of the copying paper 44*a* is not substantially at right angles to the conveying direction, it is corrected so as to be substantially at right angles thereto. At the same time, according to the advancing of the copying paper 44*a* by the pair of conveying rollers 82, the copying paper 44*a* is gradually bent downwardly upstream of the pair of timing rollers 72, namely between the pair of conveying rollers 82 and the pair of timing rollers 72.

In the copying paper conveying device 24 improved in accordance with this invention, the downstream section of the common guide plate 62 is made of a tape-like piece 70 of flexible material. Accordingly, as shown in FIG. 5-A, the tape-like piece 70 bends downwardly according to the downward bending of the copying paper 44*a*. It will be easily understood from FIG. 5-A that despite the relatively small vertical space of the upper introducing passage 46, the copying paper 44*a* is bent to a sufficiently large extent, and the aforesaid correcting action on the leading edge of the copying paper 44*a* can be performed quite surely. After the lapse of a predetermined period of time from the closing of the second detector 94 (when the copying paper 44*a* has been sufficiently bent upstream of the pair of timing rollers 72), the clutch means 116 is rendered inoperative to stop the action of the pair of conveying rollers 82. At this time, the trailing edge portion of the copying paper 44*a* is still nipped by the pair of conveying rollers 82.

Then, the detector 158 produces a signal at a predetermined time which is related properly to the rotation of the rotating drum 2. The signal production renders the clutch means 122 operative, and the pair of timing rollers 72 begin to be rotated in the direction of arrow 148. Hence, the advancing of the copying paper 44*a* is started by the action of the paper of timing rollers 72, and the copying paper 44*a* is conveyed to the transfer zone 14 (FIG. 1) in synchronism with the rotation of the rotating drum 2.

In the illustrated embodiment improved in accordance with this invention, the clutch means 116 is set in operation to start rotation of the pair of conveying rollers 82 substantially at the same time as the clutch means 122 is set in operation to start rotation of the pair of timing rollers 72. It will be easily understood from FIG. 5-A therefore that even after advancing of the copying paper 44*a* by the action of the pair of timing rollers 72 has been started, the bending of the copying paper 44*a* between the pair of conveying rollers 82 and the pair of timing rollers 72 remains substantially unchanged until the trailing edge of the copying paper 44*a* leaves the pair of conveying rollers 82. Hence, the pair of conveying rollers 82 do not exert an adverse effect on the advancing of the copying paper 44*a* by the pair of timing rollers 72. Thus, the copying paper 44*a* is conveyed to the transfer zone 14 (FIG. 1) exactly in synchronism with the rotation of the rotating drum 2. At a proper time after the trailing edge of the copying paper 44*a* has left the pair of conveying rollers 82, the pair of conveying rollers 82 can be stopped by making the clutch means 116 inoperative. Furthermore, at a suitable time after the trailing edge of the copying paper 44*a* has left the pair of timing rollers 72, the pair of timing rollers 72 can be stopped by making the clutch means 122 inoperative. In the illustrated embodiment, after a predetermined period of time has elapsed from the opening of the second detector 94 by leaving of the trailing edge of the copying paper 44*a*, the clutch means 116 and 122 are rendered inoperative, thus the pair of conveying rollers 82 and the pair of timing rollers 72 are stopped.

In the illustrated embodiment, the pair of conveying rollers 82 are rotated substantially simultaneously with the rotation of the pair of timing rollers 72. If desired, the pair of conveying rollers 82 may be rotated prior to the rotation of the pair of timing rollers 72. Furthermore, rotation of the pair of conveying rollers 82 may be started some time after the starting of rotation of the pair of timing rollers 72 so long as the bending of the copying paper 44*a* between the pair of conveying rollers 82 and the pair of timing rollers 72, even if changed slightly in extendt, can be maintained at least until the trailing edge of the copying paper 44*a* leaves the pair of conveying rollers 82. Conveniently, the speed of advancing of the copying paper 44*a* by the pair of conveying rollers 82 is substantially equal to the speed of advancing of the copying paper 44*a* by the pair of timing rollers 72, and therefore the peripheral speed of the pair of conveying rollers 82 is substantially equal to the peripheral speed of the pair of timing rollers 72. However, so long as the aforesaid condition about the bending of the copying paper is satisfied, they may be different from each other.

Now, mainly with reference to FIG. 5-B, the feeding of the copying paper 44*b* from the copying paper feed means 32*b* will be described. When as described above the clutch means 106*b* is set in operation and the feed roller 40*b* is rotated in the direction of arrow 46*b*, the uppermost copying paper 44*b* in the stack of copying paper sheets 44*b* is fed into the lower introducing passage 48. When the copying paper 44*b* being fed is delivered into the main conveying passage 50 from the lower introducing passage 48, the leading edge of the copying paper 44*b* acts on the detecting arm 104 of the second detector 94, and consequently the second detector 94 is closed. When the copying paper 44*b* being fed further advances, its leading edge abuts against the nipping portion of the timing rollers 72 in the inoperative state, and thus when the leading edge of the copying paper 44*b* is not substantially at right angles to the conveying direction, it is corrected so as to be substantially at right angles thereto. At the same time, as the copying paper 44*b* is advanced by the feed roller 40*b*, it is gradually bent upwardly at a site upstream of the pair of timing rollers 72, namely between the feed roller 40*b* and the pair of timing rollers 72.

In the paper conveying device 24 improved in accordance with this invention, the downstream section of the common guide plate 62 is formed of the tape-like piece 70 made of a flexible material, and therefore, the tape-like piece 70 bends upwardly in response to the upward bending of the copying paper 44*b* as shown in FIG. 5-B. It will be easily understood from FIG. 5-B that despite the relatively small vertical space of the lower introducing passage 48, the copying paper 44*b* is bent to a sufficiently large extent, and therefore, the aforesaid correcting action on the leading edge of the copying paper 44*b* can be performed quite surely. After the lapse of a predetermined period of time from the closing of the second detector 94 (when the copying paper 44*b* has been sufficiently bent upstream of the pair of timing rollers 72), the clutch means 106*b* is rendered inoperative to stop the feed roller 40*b*. At this time, the trailing edge portion of the copying paper 44*b* is still in contact with the feed roller 40*b*.

Then, the detector 158 produces a signal at a predetermined time properly related to the rotation of the rotating drum 2. The signal production renders the clutch means 122 operative and the pair of timing rollers 72 begin to be rotated in the direction of arrow 148. Hence, advancing of the copying paper 44*b* by the action of the pair of timing rollers 72 is started, and the copying paper 44*b* is conveyed to the transfer zone 14 (FIG. 1) properly in synchronism with the rotation of the rotating drum 2.

At the time when advancing of the copying paper 44*b* by the action of the pair of timing rollers 72 is started, the trailing edge portion of the copying paper 44*b* is in contact with the feed roller 40*b* in the inoperative state. Accordingly, as the copying paper 44*b* advances under the action of the pair of timing rollers 72, the bending of the copying paper 44*b* upstream of the pair of timing rollers 72 is gradually removed. After the bending of the copying paper 44*b* has been completely removed, the trailing edge portion of the copying paper 44*b* is forcibly separated from the feed roller 40*b*. At this time, the feed roller 40*b* is rotated in the direction of arrow 46*b* according to the advancing of the trailing edge portion of the copying paper 44*b*. When the copying paper 44*b* is advanced by the action of the pair of timing rollers 72 as described above, the trailing edge portion of the copying paper 44*b* should be forcibly separated from the feed roller 40*b* after its bending is completely removed upstream of the pair of timing rollers 72. Since the feed roller 40*b* in the inoperative state can freely rotate in the direction of arrow 46*b* and the pressure of contact between the feed roller 40*b* and the copying paper 44*b* can be considerably smaller than the nipping pressure of the pair of conveying rollers 82 and the nipping pressure of the pair of timing rollers 72, any adverse effect on the advancing of the copying paper 44*b* by the action of the pair of timing rollers 72 can be substantially obviated at the time of forcibly separating the trailing edge portion of the copying paper 44*b* from the feed roller 40*b*. Accordingly, the copying paper 44*b* is conveyed to the transfer zone 14 (FIG. 1) exactly in synchronism with the rotation of the rotating drum 2.

While one embodiment of the copying paper conveying device improved in accordance with this invention has been described in detail hereinabove with regard to a specific type of electrostatic copying apparatus illustrated in the accompanying drawings, it should be understood that the present invention is not limited to this specific embodiment, and can be applied to various other types of electrostatic copying apparatus, and various changes and modifications can be added to the above embodiment without departing from the scope of the invention.

What is claimed is:

1. An electrostatic copying apparatus, comprising a copying paper conveying device having a paper feed means for feeding a sheet of copying paper, a guide means defining a conveying passage for copying paper fed from said paper feed means, a pair of conveying rollers disposed in said conveying passage for advancing the copying paper from the paper feed means through said conveying passage, a pair of timing rollers disposed in said conveying passage downstream of the pair of conveying rollers and a control means for controlling said paper feed means, said pair of conveying rollers and said pair of timing rollers, the length of the conveying passage between the pair of conveying rollers and the pair of timing rollers being shorter than the length of the copying paper in the conveying direction, and said control means being adapted to make the pair of conveying rollers inoperative after the copying paper advancing under the action of the pair of conveying rollers in the operative state is bent between the pair of conveying rollers and the pair of timing rollers by the abutting of its leading edge against the pair of timing rollers in the inoperative state, and thereafter to make the pair of timing rollers operative at a predetermined time thereby starting the advancing of the copying paper by the pair of timing rollers, said control means also making the pair of conveying rollers operative in required relation to said predetermined time of making the pair of timing rollers operative, so that the copying paper is maintained bent between the pair of conveying rollers and the pair of timing rollers after advancing of the copying paper is started by setting the pair of timing rollers in operation and at least before the trailing edge of the copying paper leaves the pair of conveying rollers.

2. The copying paper conveying device of claim 1 wherein said control means makes the pair of conveying rollers operative substantially simultaneously with the time of making the pair of timing rollers operative.

3. The copying paper conveying device of claim 1 wherein the speed of the copying paper advanced by the pair of timing rollers is substantially equal to the speed of the copying paper advanced by the pair of conveying rollers.

4. An electrostatic copying apparatus comprising a copying paper conveying device including an upper and a lower paper feed means arranged vertically in spaced-apart relationship for feeding a sheet of copying paper, a guide means defining a paper conveying passage having an upper and a lower introducing passage extending respectively from said upper and lower paper feed means and meeting at a point and a main conveying passage extending from said point of meeting of the upper and lower introducing passages, a pair of timing rollers disposed in the upstream section of the main conveying passage, and a control means for controlling the upper and lower paper feed means and the pair of timing rollers, said control means being adapted to make the pair of timing rollers operative, and thus start advancing of the copying paper, at a predetermined time after the copying paper fed from the upper or lower paper feed means and advancing through the upper or lower introducing passage is bent upstream of the pair of timing rollers by the abutting of its leading edge against the pair of timing rollers in the inoperative state;

said guide means including a common guide plate defining at least the downstream section of the upper introducing passage and at least the downstream section of the lower introducing passage, and at least the downstream section of the common guide plate is formed of a flexible material capable of bending according to the bending of the copying paper which takes place upstream of the pair of timing roller units, wherein a pair of conveying rollers for advancing the fed copying paper are disposed in at least one of the upper and lower introducing passages, and the length of the conveying passage between the pair of conveying roller units and the pair of timing rollers is shorter than the length in the conveying direction of the copying paper advanced by the pair of conveying rollers;

and wherein said control means makes the pair of conveying rollers inoperative after the copying paper advancing under the action of the pair of conveying roller units in the operative state is bent between the pair of conveying rollers and the pair of timing rollers by the abutting of its leading edge against the pair of timing rollers in the inoperative state, and thereafter at said predetermined time, said control means makes the pair of timing rollers operative and starts advancing of the copying paper by the pair of timing rollers, and said control means also makes the pair of conveying rollers operative in required relation to said predetermined time of making the pair of timing rollers operative so that the copying paper is maintained bent between the pair of conveying rollers and the pair of timing rollers after advancing of the copying paper by the pair of timing rollers is started by setting the pair of timing rollers in operation and at least before the trailing edge of the copying paper leaves the pair of conveying rollers.

5. The copying paper conveying device of claim 4 wherein said control means makes the pair of conveying rollers operative substantially simultaneously with the time of making the pair of timing rollers operative.

6. The copying paper conveying device of claim 4 wherein the speed of the copying paper advanced by the pair of timing rollers is substantially equal to the speed of the copying paper advanced by the pair of conveying rollers.

* * * * *